US009320955B2

(12) United States Patent
Aral Diaz

(10) Patent No.: US 9,320,955 B2
(45) Date of Patent: Apr. 26, 2016

(54) WORKOUT DEVICE

(71) Applicant: Ildefonso Aral Diaz, Malaga (ES)

(72) Inventor: Ildefonso Aral Diaz, Malaga (ES)

( * ) Notice: Subject to any disclaimer, the term of this patent is extended or adjusted under 35 U.S.C. 154(b) by 42 days.

(21) Appl. No.: 14/352,261

(22) PCT Filed: Oct. 3, 2012

(86) PCT No.: PCT/ES2012/070682

§ 371 (c)(1),
(2) Date: Apr. 16, 2014

(87) PCT Pub. No.: WO2013/057342

PCT Pub. Date: Apr. 25, 2013

(65) Prior Publication Data

US 2014/0274571 A1 Sep. 18, 2014

(30) Foreign Application Priority Data

Oct. 17, 2011 (ES) ..... 201131661
Feb. 14, 2012 (ES) ..... 201230226

(51) Int. Cl.
*A63B 17/00* (2006.01)
*A63B 69/00* (2006.01)
(Continued)

(52) U.S. Cl.
CPC ..... *A63B 69/0048* (2013.01); *A63B 17/00* (2013.01); *A63B 17/02* (2013.01);
(Continued)

(58) Field of Classification Search
CPC ..... A63B 69/00; A63B 69/0048; A63B 1/00; A63B 3/00; A63B 5/00; A63B 9/00; A63B 2009/006; A63B 17/00; A63B 17/02; A63B 17/04; A63B 19/04; A63B 21/00047; A63B 21/00094; A63B 21/00098; A63B 21/00101; A63B 21/00109; A63B 21/72; A63B 21/0724; A63B 21/0728; A63B 21/078; A63B 21/1457; A63B 21/1465; A63B 2021/169; A63B 23/035; A63B 23/03508; A63B 23/03516; A63B 23/03525; A63B 23/03533; A63B 23/03541; A63B 23/0355; A63B 23/03558; A63B 23/03575; A63B 23/03583; A63B 23/03591; A63B 23/04; A63B 23/0405; A63B 23/0411; A63B 23/0458; A63B 23/0482; A63B 23/0494; A63B 23/12; A63B 23/1209; A63B 23/1218; A63B 23/1227; A63B 23/1236; A63B 23/1245; A63B 26/003; A63B 71/0036; A63B 71/023; A63B 2071/025–2071/027; A63B 2208/02; A63B 2208/0204; A63B 2208/0209; A63B 2208/0223; A63B 2208/0285; A63B 2208/029; A63B 2210/50; A63B 2225/09; A63B 2225/093; A63B 2225/10; A63B 21/1469; A63B 21/1476; A63B 23/1281
See application file for complete search history.

(56) References Cited

U.S. PATENT DOCUMENTS 1,722,844 A * 7/1929 Faulkenberry ..... 182/25
1,894,489 A * 1/1933 Hirose et al. ..... 182/23
(Continued)

*Primary Examiner* — Oren Ginsberg
*Assistant Examiner* — Gary D Urbiel Goldner
(74) *Attorney, Agent, or Firm* — Lucas & Mercanti, LLP

(57) ABSTRACT

The device is composed of a structure that comprises four inter-hinged modules (1-2-3-4), which enables multiple mounting possibilities thereof. Each module is formed of two essentially straight lateral bars (15-15') that incorporate a pair of inwardly curved sections (17), which act as links between the two lateral bars in such a way that the end of each module ends in a pair of legs in the form of forks (18), which in turn end either in support legs (19) of the device, or in a hinging means (16), it having been provided that a series of adjustable and non-essential crossbars (20-20'-20") are subject to being inserted into place in a center of the frame defined by the lateral bars (15-15'). The device is complemented by a series of accessories that make it possible to significantly increase the diverse types of exercises that may be carried out with the same.

11 Claims, 8 Drawing Sheets

(51) Int. Cl.

| | |
|---|---|
| ***A63B 17/02*** | (2006.01) |
| ***E06C 1/32*** | (2006.01) |
| ***E06C 1/39*** | (2006.01) |
| ***E06C 7/42*** | (2006.01) |
| ***E06C 7/08*** | (2006.01) |
| ***E06C 7/16*** | (2006.01) |
| ***A63B 21/072*** | (2006.01) |
| ***A63B 23/04*** | (2006.01) |
| ***A63B 21/00*** | (2006.01) |
| *A63B 71/02* | (2006.01) |
| *A63B 5/00* | (2006.01) |
| *A63B 21/078* | (2006.01) |

(52) U.S. Cl.

CPC ..... *A63B21/00047* (2013.01); *A63B 21/0724* (2013.01); *A63B 21/169* (2015.10); *A63B 21/4029* (2015.10); *A63B 23/0458* (2013.01); *E06C 1/32* (2013.01); *E06C 1/39* (2013.01); *E06C 7/081* (2013.01); *E06C 7/16* (2013.01); *E06C 7/42* (2013.01); *A63B 5/00* (2013.01); *A63B 21/078* (2013.01); *A63B 21/4035* (2015.10); *A63B 2071/025* (2013.01); *A63B 2210/50* (2013.01)

(56) References Cited

U.S. PATENT DOCUMENTS

| | | | | | |
|---|---|---|---|---|---|
| 2,899,008 | A | * | 8/1959 | Larson | 182/25 |
| 2,981,364 | A | * | 4/1961 | Webber | 182/159 |
| 3,143,185 | A | * | 8/1964 | Wenger | 182/24 |
| 3,208,553 | A | * | 9/1965 | Lanier | 182/24 |
| 3,474,881 | A | * | 10/1969 | Green | 182/24 |
| 3,547,435 | A | | 12/1970 | Scott | |
| 3,554,318 | A | * | 1/1971 | Knight | 182/24 |
| 3,709,487 | A | | 1/1973 | Walker | |
| 3,850,428 | A | * | 11/1974 | Zuber | 482/36 |
| 3,971,561 | A | | 7/1976 | Wenzel | |
| 4,376,470 | A | * | 3/1983 | Ashton | 182/23 |
| 4,549,632 | A | * | 10/1985 | Inoue | 182/23 |
| 4,630,819 | A | | 12/1986 | Levin | |
| 4,648,481 | A | * | 3/1987 | Lee | 182/28 |
| 4,759,539 | A | * | 7/1988 | Nieppola | 482/36 |
| 4,815,564 | A | * | 3/1989 | Yoo | 182/160 |
| 4,842,098 | A | * | 6/1989 | Yuen | 182/22 |
| 4,921,245 | A | | 5/1990 | Roberts | |
| 5,066,001 | A | | 11/1991 | Wilkinson | |
| 5,086,872 | A | * | 2/1992 | Lin | 182/18 |
| 5,163,532 | A | * | 11/1992 | McCarty | 182/163 |
| 5,228,535 | A | * | 7/1993 | McCarty | 182/163 |
| 5,279,387 | A | * | 1/1994 | Swiderski et al. | 182/27 |
| 5,358,069 | A | * | 10/1994 | Krause | 182/118 |
| 5,711,400 | A | * | 1/1998 | Tan | 182/119 |
| 7,361,123 | B1 | | 4/2008 | Krull | |
| 8,424,639 | B1 | * | 4/2013 | Davis | 182/20 |
| 8,800,718 | B2 | * | 8/2014 | Allred et al. | 182/178.2 |
| 2002/0123415 | A1 | | 9/2002 | Marques | |
| 2004/0129497 | A1 | * | 7/2004 | Weiss | 182/163 |
| 2005/0029044 | A1 | * | 2/2005 | Latimer et al. | 182/78 |
| 2008/0190698 | A1 | * | 8/2008 | Amalric et al. | 182/207 |
| 2011/0056764 | A1 | * | 3/2011 | Cross et al. | 182/27 |
| 2013/0037351 | A1 | * | 2/2013 | Gallup et al. | 182/129 |
| 2013/0203569 | A1 | * | 8/2013 | Athis | 482/142 |
| 2013/0292205 | A1 | * | 11/2013 | Frick et al. | 182/156 |
| 2013/0324383 | A1 | * | 12/2013 | Rogers | 482/142 |
| 2014/0284140 | A1 | * | 9/2014 | Omri | 182/22 |
| 2015/0059257 | A1 | * | 3/2015 | Beaver et al. | 52/27 |

* cited by examiner

WORKOUT DEVICE

CROSS-REFERENCE TO RELATED APPLICATIONS

This application is a 371 of PCT/ES2012/070682 filed Oct. 3, 2012, which in turn claims the priority of ES P201131661 filed Oct. 17, 2011 and ES P201230226, filed Feb. 14, 2012 the priority of the three applications is hereby claimed and the three applications are incorporated by reference herein.

OBJECT OF THE INVENTION

The present invention refers to a workout device and more specifically to a structure with characteristics that enable it to be transformed in order to achieve different positions to carry out diverse physical and sports exercises.

The object of the invention is to achieve a structure with a wide range of possibilities, which enables users, via simple transformations, to adjust it for any requirement, in order to carry out different exercises.

BACKGROUND OF THE INVENTION

Although there are many very different types of workout apparatuses that are currently used, both indoors and outdoors, and despite said workout apparatuses enabling different types of exercises to be carried out, there are however no known transformable structures that provide different configurations to carry out varied and multiple physical exercises such as the one that the invention proposes.

DESCRIPTION OF THE INVENTION

The proposed workout device is composed of a structure made up of four modules that are inter-articulated through three pairs of hinges, such that there are two intermediate modules and two end or free modules, each module forming a body in the form of ladders with two side rails and various crossbars, such that the latter brace together the side rails and may also be situated with greater or lesser distance in order to carry out different types of exercises.

The hinging of the modules enables them to be positioned in the form of a bridge, with two top and horizontal modules to carry out physical exercises underneath them, such as bicep, back and abdominal exercises, whilst the other two sections, i.e. the ends, are situated either vertically or at an incline, both forming ladder sections.

In any case, the end sections include support legs at each free edge to stabilise the assembly on the ground, whilst on the side rails of the two intermediate modules, when the structure is provided with a bridge shape, there is the possibility of mounting cylindrical stops for the arrangement of straps with rings that enable different types of exercises to be carried out.

The structure described may be folded so that the modules are superimposed on one another in the form of an "M", with support legs for stability in the folded position, and for stability during transport, in addition having retractable wheels to be able to move the structure from one place to another without any problems.

In addition, the workout device or structure is complemented by a platform capable of covering and coupling over one of the sections to enable users to jump upon the same, the end section also having support legs to keep the folded assembly stable and enable this stability during the jumping exercises, which are carried out on the platform situated on the top module, and logically to achieve a horizontal use of the folded workout device or structure according to the above.

The structure may also be arranged in a "C"-shape, i.e. with the two vertical inner or intermediate sections and the two horizontal outer sections, one at the bottom and the other on top, in such a way that the aforementioned platform may be placed on top of the bottom section, and compose a support surface to start and finish climbing along the crossbars or ladders that form the two intermediate and vertical modules, said structure having adjustable legs to achieve optimal structural stability in this position.

Likewise, the assembly or structure may adopt a position in which three of its modules are completely unfolded vertically, and the fourth forms a 90° angle with the previous modules, or even an obtuse angle for the bottom module, and the other three modules are aligned, to adopt the vertical position as previously mentioned, or an inclined position to form a climbing ladder, to be able to carry out other types of exercises, etc.

In addition, the aforementioned workout device or structure is complemented by other supplements composed of a bar with hoops the may lock onto the crossbars of one of the modules, to form a grip bar and carry out different physical exercises, this bar at the same time having at one end a kind of fork in which to position one of the crossbars and thereby act upon the top module and position it with one inclination or another.

The device may incorporate hooks for wall mounting.

Multiple physical exercises may be carried out via the structure of the aforementioned workout device, from carrying out climbing techniques to carrying out bleep, back and abdominal exercises, carrying out lifting and lowering exercises via straps and/or ropes, lifting exercises with rings, etc.

Lastly, it must be noted that some of the crossbars of the different modules may have irregularities in their arrangement to simulate climbing holds.

According to a variation of the embodiment of the invention, it is provided that each module is formed of two essentially straight lateral bars that are symmetrical with respect to an imaginary intermediate axis of symmetry, which incorporates a pair of inwardly curved sections, which act as links between the two bars, through the complementary fixing means, whether via screws, welding, etc., defining an essentially rectangular frame, from whose ends emerge respective legs in the form of forks, which end either in the support legs of the device or in the hinging means between each module.

In the centre of the essentially rectangular frame, a series of adjustable, transverse crossbars are subject to optionally being inserted, which may be put in place through any conventional fixing means.

The crossbars may be cylindrical, though they may also have other configurations, with irregular surfaces, with an ergonomic configuration to adapt to the geometry of the hand of the users, or have a perimeter groove to fix ropes or rings, as shown below.

Coming back to the jumping platform, it is provided that, in the area where the two bars that compose each module join together, a hole is defined on the outside for coupling an immobilising element between modules, in such a way that it is embodied in a kind of vertical bar, from which a series of extensions emerge perpendicularly that fit into the aforementioned holes, in such a way that they fit in a minimal volumetric position stabilising the assembly, or that the device may be partially unfolded, in the form of a concertina, equally being immobilised via these elements, and offering a greater height for its platform, composing an element to be jumped over or jumped on at a greater height, in such a way that depending on the height at which it is adjusted, it may be used as a sort of "plinth".

In a folded arrangement taking up a minimal volumetric space, the device may be used in the form of a body-building element, i.e. in the form of a weight to be lifted by the user, through the corresponding crossbars, preferably two, which do not affect the bracing of the module and which are small and are preferably found inside one of the intermediate frames.

In the same way, the device, in said folded arrangement, and with the dismounted crossbars, may compose an element in the form of a "box" in which the platform is the base, none of the modules having crossbars with the exception of the third module, where a large number of crossbars will be placed to form the base of the compartment where all the accessories may be kept and the platform being used as a lid for transport thereof.

Similarly and having a second pair of crossbars that couple perpendicularly to another pair of crossbars coupled in turn to an intermediate module, a space may be defined for the head of the user to pass through, and for his/her shoulders to be supported on, in such a way that through said setup the user may carry out body-building exercises, making the device move up and down by supporting the same on his/her shoulders.

Likewise, it has been provided that the device be complemented by an accessory that is coupled between a pair of crossbars, embodied in a plate or sheet from which a tube or bar emerges perpendicularly, intended for weights to be placed on it, in order to increase the weight of the device, when it is being used folded as an element to be lifted.

The device may incorporate hooks for wall mounting.

Due to the great transformability of the device, it may be placed in other positions that have not described.

DESCRIPTION OF THE DRAWINGS

To complement the description that will be carried out below and with the object of aiding in better understanding the characteristics of the invention, the present specification is accompanied by a set of drawings from which the benefits and the advantages of the workout device, object of the invention, may be easily understood.

PREFERRED EMBODIMENT OF THE INVENTION

Firstly taking into consideration the example of a practical embodiment in FIGS. 1 to 7, it is seen therein how the workout device of the invention is composed of a structure determined by four modules that are inter-connected via respective lockable hinges (5), each module being formed of two side rails (6) and crossbars (7) that connect and brace together each pair of side rails (6) corresponding to the respective modules (1, 2, 3 and 4).

Figure 1:
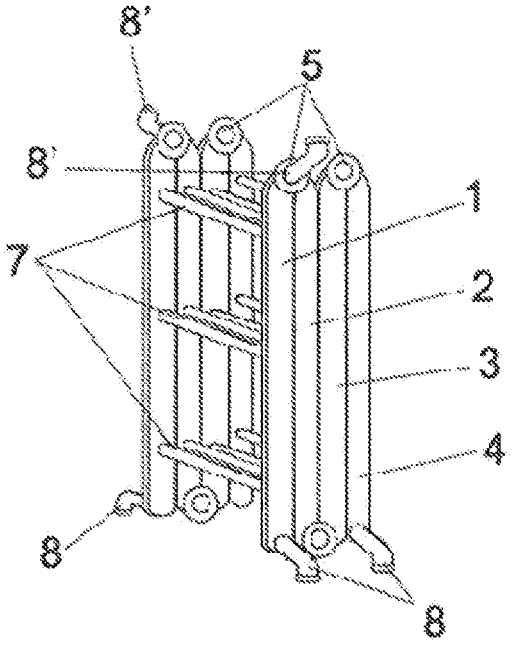
FIG. 1.—Shows, according to a perspective view, the structure that the workout device of the invention takes on in a folded position.
Figure 4:
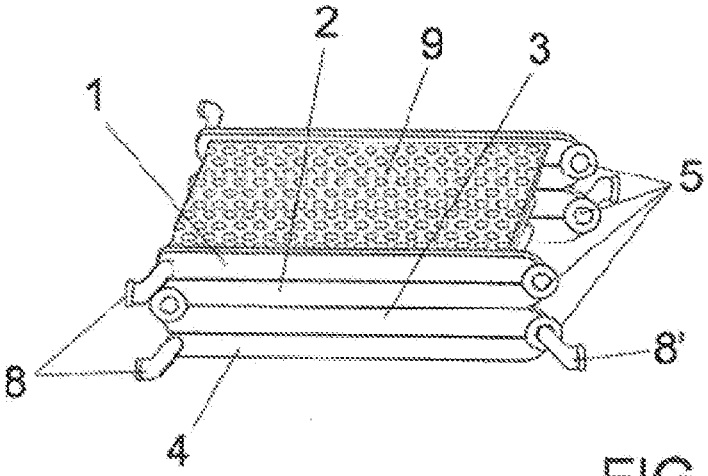
FIG. 4.—Shows a perspective view like that of FIG. 1, but with the folded structure in a lowered position, and in which the top module includes the platform to be jumped upon.
Figure 5:
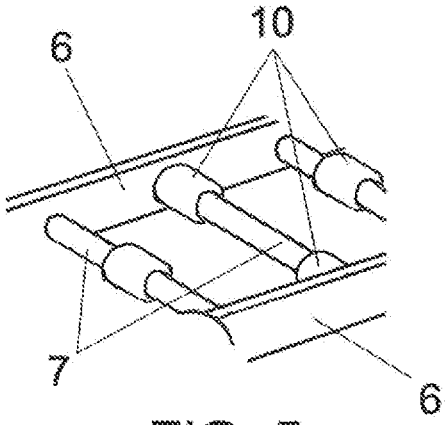
FIG. 5.—Shows a detailed view of part of a module with the cylindrical stops situated on one of the crossbars for mounting the ring straps or other elements for physical exercises.
Figure 6:
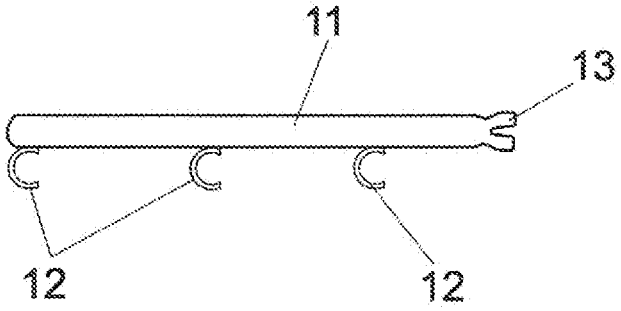
FIG. 6.—Shows a longitudinal detailed view of the bar with the hoops for coupling to the crossbars of one of the modules and the fork-shaped end of said bar to enable the lifting or pushing of the corresponding top module in FIG. 3.
Figure 7:
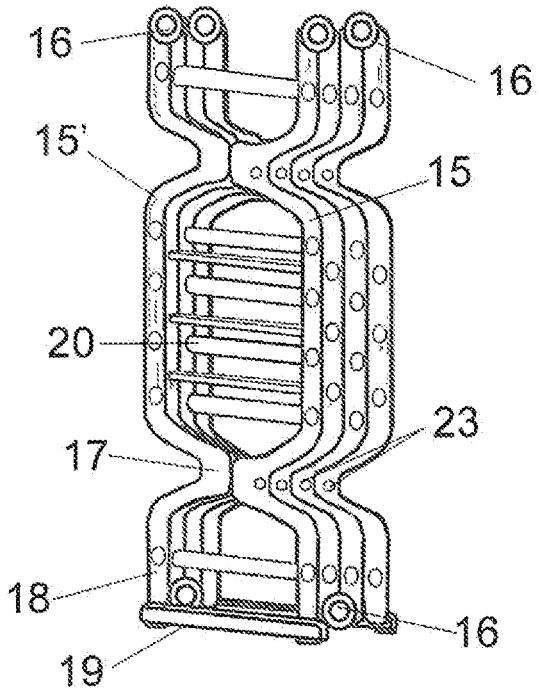
FIGS. 7, 8, 9 and 10.—Show four different perspectives similar to those of FIGS. 1, 2, 3 and 4, but which belong to a variant of the embodiment of the workout device.

The end modules (1 and 4) include support legs (8) to situate the assembled structure in a stable arrangement, both in a folded and unfolded position, in addition including retractable wheels to enable it to roll in a folded position, one of the end modules, specifically module (4), also including stops (8') with the function of support legs in the lowered position of the folded structure, i.e. that it may have a vertical position, as represented in FIG. 1, being supported on the legs (8), or the lowered position as represented in FIG. 4, being supported on these other stops or legs (8').

In this position, represented in FIG. 4, the folded structure may be complemented by a non-slip platform (9) that is situated on the rungs of the respective top module (1) and shall be used by the user to jump.

Figure 2:
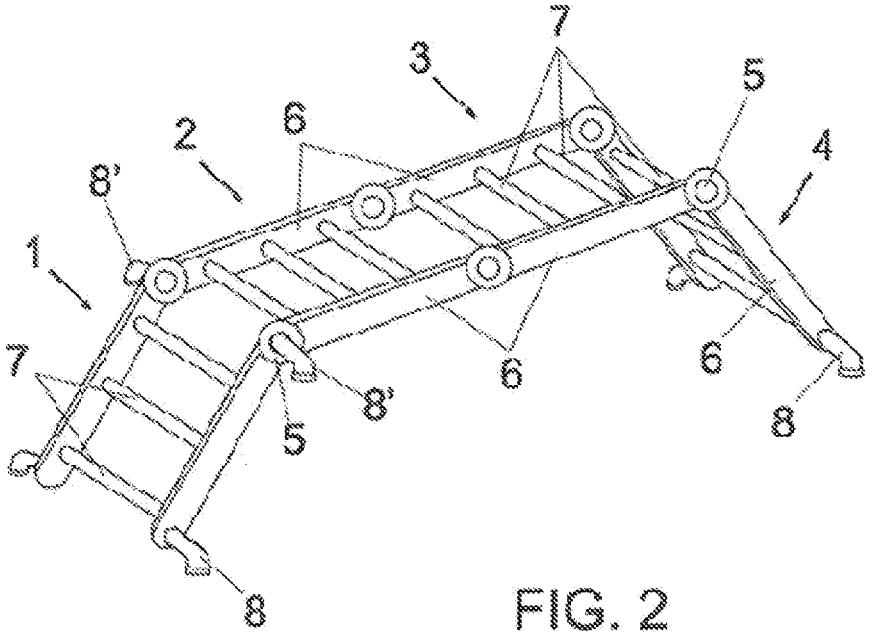
FIG. 2.—Shows, also according to a perspective view, the workout device of the invention with its structure taking the shape of a kind of bridge.

In FIG. 2 it may be seen how the structure adopts a bridge shape, in which the intermediate modules (2 and 3) are arranged on top and horizontally, whilst the end modules (1 and 4) are in an inclined arrangement, although they may also be in a vertical arrangement, in such a way that in any case the users or athletes would move along the inner part and underneath the structure, carrying out climbing or scaling exercises, equally being able to carry out lifting exercises by gripping the crossbars (7) of these intermediate modules (2 and 3) with their hands, carrying out pectoral and tricep work.

A cushion may be situated on top of these intermediate modules (2 and 3) and enable lumbar exercises to be carried out.

In this position, cylindrical stops (10) may be placed on the crossbars (7), as another one of the complements of the structure, leaving space between the stops to place straps with training rings and carry out suspension exercises, with the possibility of moving underneath, carrying out climbing techniques and a multitude of bicep, back and abdominal exercises, etc.

Figure 3:
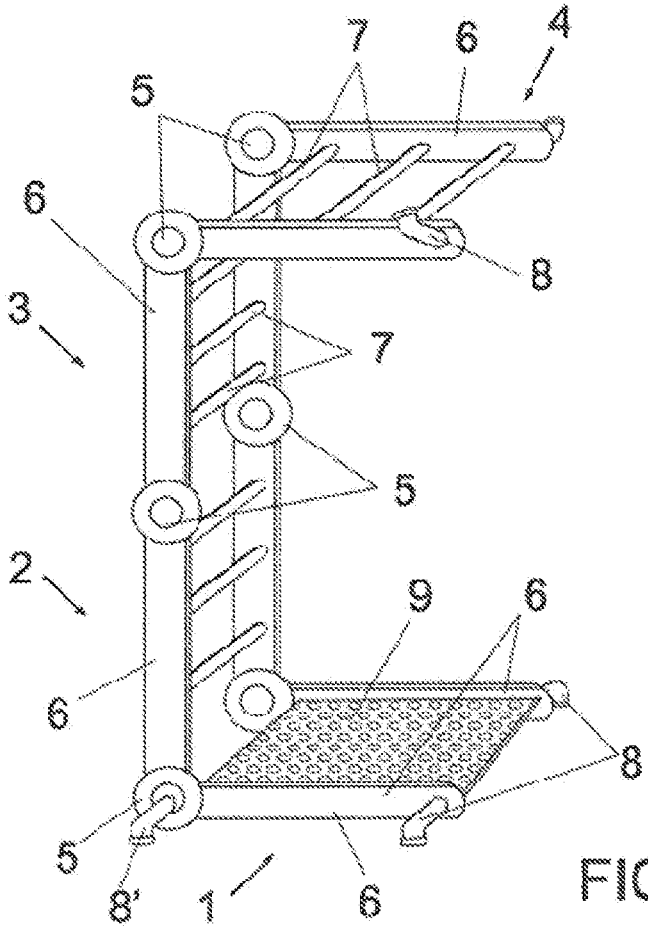
FIG. 3.—Shows another perspective view of the same structure as in the previous figures, in this case taking on a "C" arrangement.

The structure may also be arranged in a "C"-shape as represented in FIG. 3, in which the intermediate modules (2 and 3) are arranged vertically, and the end modules (1 and 4) in a horizontal position, with module (1) located at the bottom and with module (4) located at the top.

In this position, represented in FIG. 3, the workout device may be complemented by another accessory composed of a bar (11) with coupling elements in the form of hoops (12) for it to be booked onto the crossbars (7) of this top end module (4), on the one hand enabling gripping and corresponding transport, and on the other hand enabling abdominal, bicep exercises, etc. to be carried out by placing the hands longitudinally.

Said bar (11) has a kind of fork (13) at its end that enables the top section or module (4) to be swung up from the ground and hook one of the crossbars (7) of said module (4) onto this fork (13), enabling said module to be inclined more or less.

In the position of FIG. 3, the structure may be complemented by adjustable legs to give the assembly greater strength and stability, as well as achieve the desired height to be able to level out the work section, which in this case will be composed by the module (4).

The structure may be arranged in such a way that modules (1, 2 and 3) are arranged vertically and module (4) in a horizontal position, or the latter in a horizontal position and the aforementioned other three in an inclined arrangement, forming a ladder to climb, with a projection to carry out all types of exercises. This is to say that in this position the structure may reach a maximum working height and may be used, in combination with the aforementioned stops (10), to fasten straps or pull cords, as well as sports simulators with lines of kite surfing bars to practice tricks or carry out lifting exercises with the rings, although the device is mainly orientated, but not limited, to the practice of CrossFit.

Now moving on to the device in FIGS. 7 to 16, in which there are similarly four modules (1, 2, 3, 4), inter-articulated via respective pairs of hinges (16), two intermediate modules and two end or free modules also being defined.

More specifically, each module is formed of two essentially straight lateral bars (15, 15'), which incorporate a pair of inwardly curved sections (17), which act as links between the two bars, through the complementary fixing means, in such a way that the end of each module ends in a pair of legs in the form of forks (18), which in turn end in either the support legs (19) of the device, or in the aforementioned hinging means (16).

In the centre of the frame defined by the lateral bars (15-15'), a series of transverse crossbars (20-20'-20") are subject to being inserted into place, which are cylindrical, although they may have other configurations, with irregular surfaces, with an ergonomic configuration to adapt to the geometry of the hand of the users, or have a perimeter groove to fix ropes or rings, equally acting as a bracing element.

Figure 8:
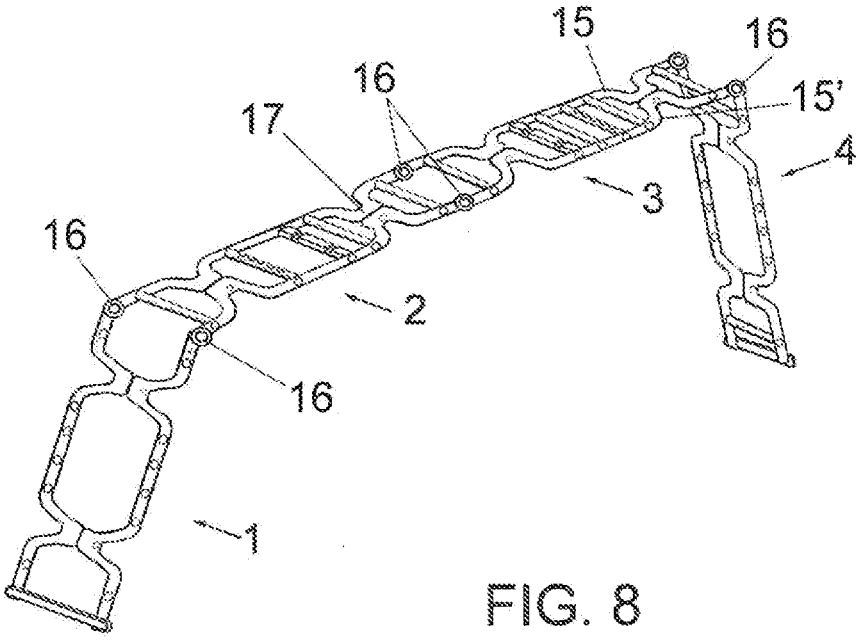

The hinges (16) of the modules enable them to be positioned in the form of a bridge, as shown in FIG. 8, to be able to carry out physical exercises such as bicep, back and abdominal exercises whilst the other two sections, i.e. the ends, are situated either vertically or at an incline, each forming sections in the form of ladders.

Figure 10:
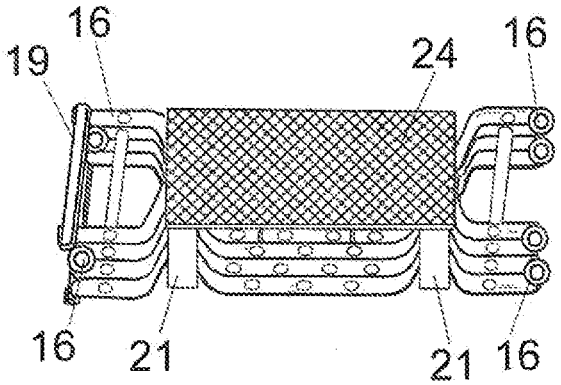
Figure 11:
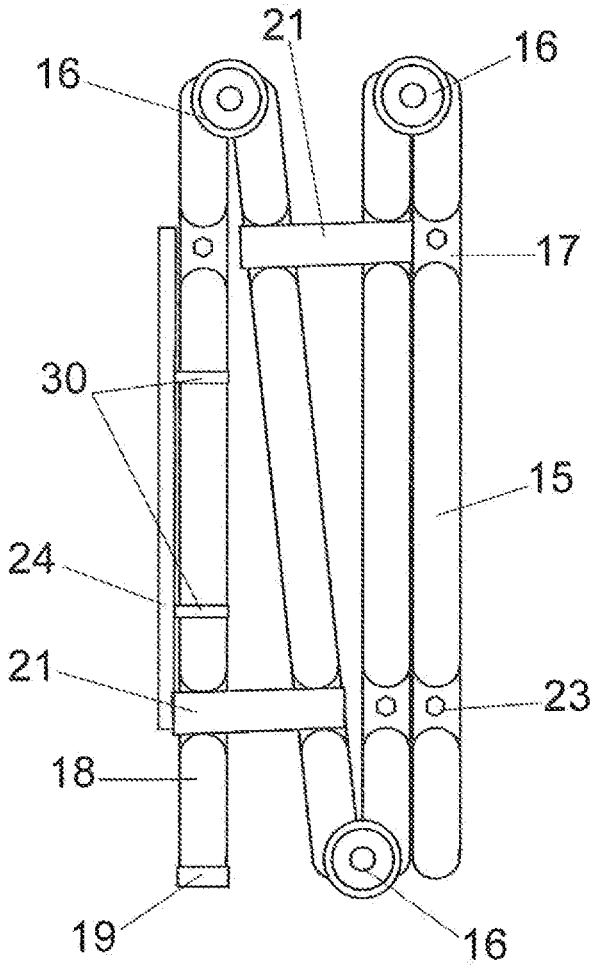
FIG. 11.—Shows a side view of the device partially folded in the form of a concertina.

The device may likewise be folded, the modules being superimposed on one another in the form of an "M", as shown in FIGS. 10 and 11, also having retractable wheels to be able to move the structure from one place to another without any problems.

Figure 9:
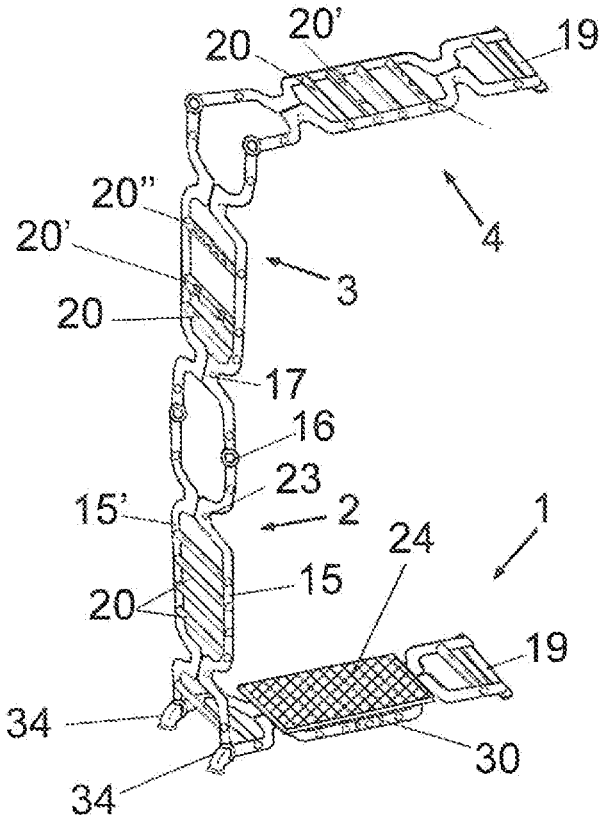

As may be seen in FIGS. 9, 10 and 11, one of the end modules is complemented by a platform (24) capable of coupling to and covering said module, to enable users to jump upon the same, as well as being used in the form of an obstacle that may be jumped over.

Figure 12:
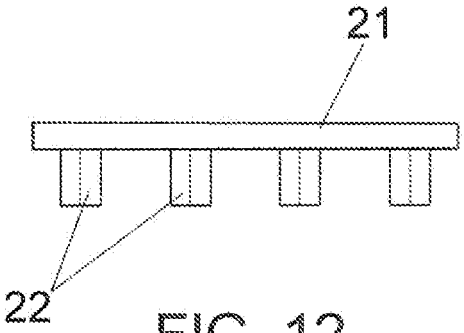
FIG. 12.—Shows a longitudinal detailed view of the bar with the hoops for coupling to the crossbars of one of the modules and the fork-shaped end of said bar to enable the lifting or pushing of the corresponding top module in FIG. 3.

In the area where the two bars (15-15') that compose each module join together, a hole (23) is defined on the outside for coupling an immobilising element (21) between modules, in such a way that they are embodied in a kind of vertical bar, the one shown in detail in FIG. 12, from which a series of extensions (22) emerge perpendicularly that fit into the aforementioned holes, in such a way that these fit in a minimal volumetric position stabilising the assembly, or the device may be partially unfolded, in the form of a concertina, as shown in FIG. 11, likewise being immobilised via these elements, and offering a greater height to its platform, composing an element to be jumped over, in such a way that depending on the height at which it is adjusted, it may be used as a sort of "plinth".

As previously mentioned, in a folded arrangement taking up a minimal volumetric space, the device may be used in the form of a body-building element, i.e. in the form of a weight to be lifted by the user, through the corresponding crossbars.

Figure 15:
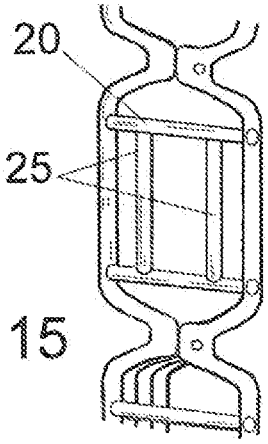

In the same way, and having a second pair of crossbars (25) that may be coupled perpendicularly to a pair of crossbars (20) coupled to an intermediate module, as shown in FIG. 15, a space may be defined for the head of the user to pass through, and for his/her shoulders to be supported on, so that the user may carry out body-building exercises through said structure, making the device move up and down via support of the same on their shoulders.

According to another one of the multiple options for use that the device of the invention offers, the structure may also be arranged in a "C"-shape, as shown in FIG. 9, i.e. with two vertical inner or intermediate sections and the two horizontal outer sections, one at the bottom and the other on top, in such a way that the aforementioned platform (24) may be placed on the bottom section, via hooking means (30), and compose a support surface to start and finish climbing along the crossbars or ladders that form the two intermediate and vertical modules, said structure having adjustable legs to achieve optimal stability.

Figure 13:
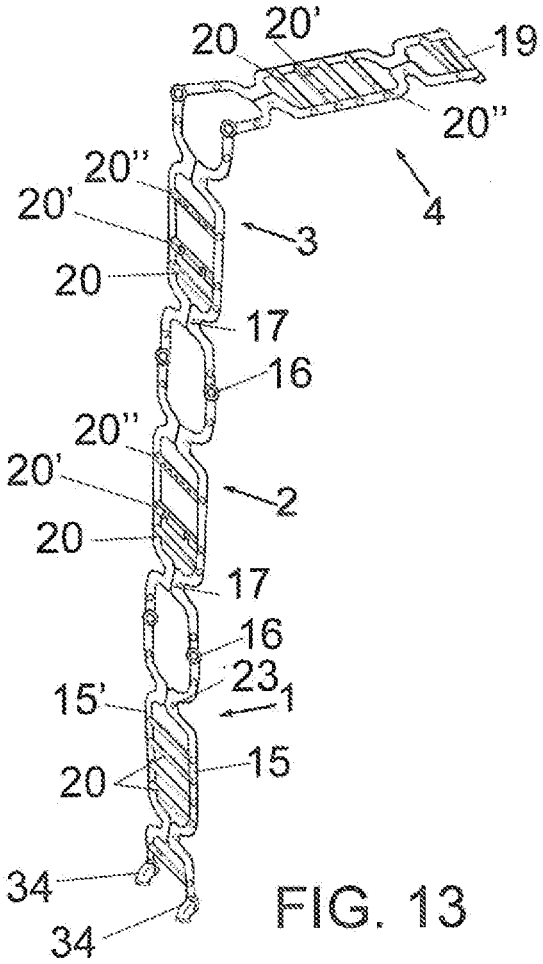
FIG. 13.—Shows a perspective view of the device in an alternative mounting position to that of FIGS. 1 to 4.

As shown in FIG. 13, the assembly or structure may occupy a position in which three of its modules are completely unfolded vertically and the fourth forms a 90° angle with the previous modules, or even an obtuse angle.

Figure 14:
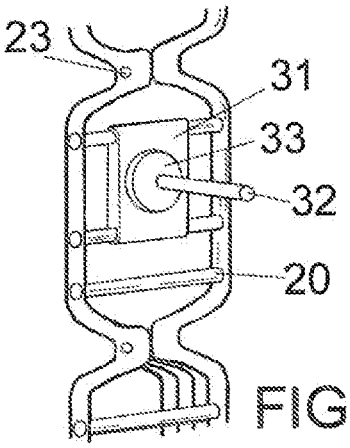
FIGS. 14 and 15.—Show two different detailed perspective views of variations on the mounting of the intermediate modules.

According to the embodiment shown in FIG. 14, the device is complemented by an accessory that is coupled between a pair of crossbars, embodied in a plate (31) or sheet from which a tube (32) emerges perpendicularly, intended for weights (33) to be placed on it, in order to increase the weight of the device, when it is being used folded as an element to be lifted.

The intermediate module (2) is equipped with adjustable legs (34), as may be seen in FIG. 9.

Figure 16:
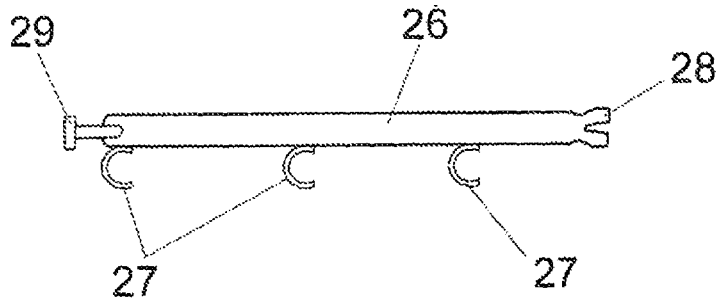
FIG. 16.—Lastly, shows an elevation view of an accessory for the workout device of the invention, specifically a bar equipped with hooks and a complementary fork of the top or end module.

As may be seen in FIG. 16, the aforementioned workout device or structure is also complemented by another supplement composed of a bar (26) with hoops (27) that can lock onto the crossbars of one of the modules, to form a grip bar and carry out different physical exercises, this bar at the same time having at one end a kind of fork (28) in which to position one of the crossbars and thereby act upon the top module and position it with one inclination or another, the complementary end ending in a support element (29).

Although it has not been represented in the figures, the device may incorporate hooks for wall mounting, as well as handles on the sides of some of the modules to facilitate its transport.

The invention claimed is:

1. A workout device comprising:

first, second, third, and fourth modules, attached sequentially such that the first and fourth modules are end modules, and the second and third modules are intermediate modules, wherein the first and second modules are connected by at least one first hinge mechanism, wherein the second and third modules are connected by at least one second hinge mechanism, and wherein the third and fourth modules are connected by at least one third hinge mechanism, wherein each of the first, second, third, and fourth modules include:

first and second lateral bars, each lateral bar having one or more straight sections and a plurality of inwardly curved sections comprising at least a first inwardly curved section and a second inwardly curved section, wherein the first inwardly curved section of the first lateral bar is linked to the corresponding first inwardly curved section of the second lateral bar, thereby linking the first and second lateral bars, wherein respective ends of the first and second lateral bars form first, second, third, and fourth legs wherein first and second legs of the first module form first and second support legs of the workout device, wherein third and fourth legs of the fourth module form third and fourth support legs of the device, wherein third and fourth legs of the first module are connected to first and second legs of the second module by the at least one first hinge mechanism, wherein third and fourth legs of the second module are connected to first and second legs of the third module by the at least one second hinge mechanism, wherein third and fourth legs of the third module are connected to first and second legs of the fourth module by the at least one third hinge mechanism; and a plurality of first crossbars adapted to being inserted between and perpendicularly to each of the one or more straight sections of the first and second lateral bars, wherein each of the plurality of first crossbars is spaced apart from each of the plurality of inwardly curved sections.

2. The workout device, according to claim 1, wherein each of the first crossbars has a cylindrical shape, and one of an irregular surface with an ergonomic configuration to adapt to a geometry of a hand of a user, and a perimeter groove for use in fixing ropes or rings.

3. The workout device, according to claim 1, further comprising one or more retractable wheels adapted to enable the workout device to be transported when the workout device is in a folded arrangement.

4. The workout device, according to claim 1, further comprising a platform that couples to the first module.

5. The workout device, according to claim 1, wherein each inwardly curved section of the plurality of curved sections includes a hole; wherein a first selected module is one of the first, second, third, and fourth modules; wherein a second selected module is one of the first, second, third, and fourth modules, the second selected module being different than the first selected module; wherein the hole in one inwardly curved section of the first selected module is adapted to being linearly aligned with the hole in one inwardly curved section of the second selected module; the workout device further comprising: an immobilizing element having a plurality of extensions comprising at least a first extension and a second extension, wherein when the holes of the inwardly curved sections of the first and second selected modules are linearly aligned, the immobilizing element is adapted to immobilize the first and second selected modules relative to each other by selectively fitting the first and second extensions of the plurality of extensions respectively into the linearly aligned holes of the inwardly curved sections of the first and second selected modules.

6. The workout device, according to claim 1, further comprising:

a pair of second crossbars adapted to couple perpendicularly to two of the first crossbars coupled to one of the second and third modules, defining a space for a head of a user to pass through, and providing a support for shoulders of the user.

7. The workout device, according to claim 1, wherein the workout device further comprises an accessory coupled between two of the first crossbars coupled to one of the first, second, third, and fourth modules the accessory comprising:

a plate; and a tube positioned perpendicularly to the plate, the tube adapted to hold one or more weights.

8. The workout device, according to claim 1, wherein the workout device further comprises an accessory that includes a bar and a plurality of hoops attached to the bar, wherein each of the plurality of hoops is adapted to lock onto a selected one of the first crossbars of a selected one of the first, second, third, and fourth modules, wherein a first end of the bar comprises a fork and a second end of the bar comprises a support element.

9. The workout device, according to claim 1, further comprising a plurality of hooks for use in wall mounting.

10. The workout device, according to claim 1, further comprising a plurality of manual transport handles disposed on a selected side of a selected one of the first, second, third, and fourth modules.

11. The workout device, according to claim 1, wherein the second module includes a plurality of adjustable legs.

* * * * *